US009218772B2

(12) United States Patent
Kim

(10) Patent No.: US 9,218,772 B2
(45) Date of Patent: Dec. 22, 2015

(54) BACKLIGHT DRIVER OF LIQUID CRYSTAL DISPLAY DEVICE AND METHOD OF DRIVING THE SAME

(71) Applicant: LG Display Co., Ltd., Seoul (KR)

(72) Inventor: Min-Kyu Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 87 days.

(21) Appl. No.: 14/082,382

(22) Filed: Nov. 18, 2013

(65) Prior Publication Data

US 2014/0184485 A1 Jul. 3, 2014

(30) Foreign Application Priority Data

Dec. 27, 2012 (KR) ..... 10-2012-0154776

(51) Int. Cl.
*G09G 3/34* (2006.01)

(52) U.S. Cl.
CPC ..... *G09G 3/3406* (2013.01); *G09G 2320/0247* (2013.01); *G09G 2320/064* (2013.01)

(58) Field of Classification Search
CPC ..... G09G 3/3406
USPC ..... 345/102
See application file for complete search history.

(56) References Cited

U.S. PATENT DOCUMENTS

2005/0104837 A1 5/2005 Baik et al.
2009/0184917 A1 7/2009 Park et al.
2009/0189842 A1 7/2009 Huang et al.
2009/0273558 A1 11/2009 Lee
2010/0091048 A1* 4/2010 Aitken et al. ..... 345/690
2011/0267387 A1 11/2011 Baik et al.
2012/0169801 A1* 7/2012 Lee et al. ..... 345/691

FOREIGN PATENT DOCUMENTS

CN 1570737 A 1/2005
CN 101494030 A 7/2009
CN 101494033 A 7/2009
CN 101572058 A 11/2009

(Continued)

OTHER PUBLICATIONS

Chinese Office Action dated Aug. 5, 2015, in Chinese Patent Application No. 201310507325.4.

(Continued)

*Primary Examiner* — Dennis Joseph
(74) *Attorney, Agent, or Firm* — Morgan, Lewis & Bockius LLP

(57) ABSTRACT

A backlight driver and a method of driving the same are disclosed. The backlight driver includes a vertical synchronization signal filter for generating a second vertical synchronization signal based on an input first vertical synchronization signal, and selecting one of the first vertical synchronization signal and the second vertical synchronization signal as a third vertical synchronization signal according to whether a period difference between adjacent first vertical synchronization signals satisfies a preset threshold range, a duty ratio detector for detecting a duty ratio of an input pulse width modulation (PWM) signal, a PWM generator for generating an output PWM signal synchronized with the third vertical synchronization signal output from the vertical synchronization signal filter and having the duty ratio and outputting the output PWM signal to a backlight unit.

9 Claims, 8 Drawing Sheets

(56) References Cited

FOREIGN PATENT DOCUMENTS

| | | | |
|---|---|---|---|
| CN | 102237043 | A | 11/2011 |
| KR | 10-2010-0140615 | * | 7/2012 |

OTHER PUBLICATIONS

Chinese Search Report dated Oct. 24, 2013, in Chinese Patent Application No. 201310507325.4.

* cited by examiner

BACKLIGHT DRIVER OF LIQUID CRYSTAL DISPLAY DEVICE AND METHOD OF DRIVING THE SAME

This application claims the benefit of Korean Patent Application No. 10-2012-0154776, filed on Dec. 27, 2012, which is hereby incorporated by reference as if fully set forth herein.

BACKGROUND OF THE INVENTION

1. Field of the Invention

The present invention relates to a backlight driver of a liquid crystal display device, and more particularly, to a backlight driver of a liquid crystal display device and a method of driving the same, for simultaneously preventing backlight flicker and wavy noise by filtering an input synchronization signal.

2. Discussion of the Related Art

Representative examples of a flat display apparatus for displaying an image using digital data include a liquid crystal display (LCD) device using liquid crystal, a plasma display panel (PDP) using discharge of inert gas, a organic light emitting diode (OLED) display device using an OLED, and the like. Among these, the LCD device has been widely used in various application fields such as in a television (TV), a monitor, a notebook computer, and a portable phone.

An LCD device displays an image through a pixel matrix using the electrical and optical properties of liquid crystal having anisotropic properties with respect to refractive index, dielectric constant, and the like. Each pixel of the LCD device implements a gray level by adjusting optical transmittance with respect to a polarization plate using variation in liquid crystal arrangement direction according to a data signal. The LCD device includes a liquid crystal panel for displaying an image through the pixel matrix, a drive circuit for driving the liquid crystal panel, a backlight unit for irradiating light to the liquid crystal panel, and a backlight driver for driving the backlight unit.

The backlight driver for drive of the backlight unit controls the brightness of the backlight unit by adjusting on/off time of the backlight unit according to a duty ratio of a pulse width modulation (PWM) signal input from a TV set or a timing controller.

In this case, the backlight driver detects the duty ratio of the input PWM signal and reflects the detected duty ratio to a vertical synchronization signal input from a timing controller to generate and use an output PWM signal for control of the backlight unit in order to drive the backlight unit according to the liquid crystal panel.

The backlight driver receives a vertical synchronization signal (hereinafter, referred to as Vsync) for distinguishing a frame of image data from an external system or the timing controller and uses the Vsync in order to drive the backlight in synchronization with the liquid crystal panel.

However, in a conventional backlight driver, during a process in which a PWM drive frequency changes along with change in a frequency of an input image, that is, a frequency of an input Vsync, a PWM duty ratio is distorted to a recognizable level or more, resulting in backlight flicker, as shown in FIG. 1.

To address this problem, a method of preventing backlight flicker by slowly changing a PWM drive frequency when a frequency of the input Vsync changes has been suggested, as shown in FIG. 1B. However, when the PWM drive frequency is slowly changed, since synchronization with the input Vsync is distorted, wavy noise occurs.

SUMMARY OF THE INVENTION

Accordingly, the present invention is directed to a backlight driver of a liquid crystal display device and a method of driving the same that substantially obviate one or more problems due to limitations and disadvantages of the related art.

An object of the present invention is to provide a backlight driver and a method of driving the same, for simultaneously preventing backlight flicker and wavy noise by filtering an input synchronization signal.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a backlight driver includes a vertical synchronization signal filter for generating a second vertical synchronization signal based on an input first vertical synchronization signal, and selecting one of the first vertical synchronization signal and the second vertical synchronization signal as a third vertical synchronization signal according to whether a period difference between adjacent first vertical synchronization signals satisfies a preset threshold range, a duty ratio detector for detecting a duty ratio of an input pulse width modulation (PWM) signal, and a PWM generator for generating an output PWM signal synchronized with the third vertical synchronization signal output from the vertical synchronization signal filter and having the duty ratio and outputting the output PWM signal to a backlight unit.

The backlight driver may further include a frequency analyzer disposed at an input terminal of the vertical synchronization signal filter and for detecting and outputting a first period of the first vertical synchronization signal. The vertical synchronization signal filter may generates a second period of the second vertical synchronization signal based on the first period of the first vertical synchronization signal and a time difference between the start timings of the first vertical synchronization signal and the second vertical synchronization signal, may select one of the first vertical synchronization signal and the second vertical synchronization signal as the third vertical synchronization signal according to whether a difference between first periods of adjacent first vertical synchronization signals satisfies the threshold range, and may select one of the first period of the first vertical synchronization signal and the second period of the second vertical synchronization signal as a third period of the third vertical synchronization signal.

The vertical synchronization signal filter may include a second vertical synchronization signal generator for generating and outputting the second vertical synchronization signal with the second period, a time difference detector for detecting a time difference between the start timings of the first vertical synchronization signal and the second vertical synchronization signal from the second vertical synchronization signal generator, a first difference calculator for calculating a first difference between the first period of the first vertical synchronization signal and the time difference from the time difference detector to output the second period of the second vertical synchronization signal, a second difference calculator for calculating and outputting a second difference between the first periods of the adjacent first vertical synchronization signals, a first determining unit for determining whether the second difference from the second difference calculator satisfies a first threshold range to generate a flag signal in synchronization with the first vertical synchronization signal, a second determining unit for determining whether the second difference from the second difference calculator satisfies a second threshold range to generate a flag signal in synchronization with the second vertical synchronization signal, a first multiplexer for selecting one of the first vertical synchronization signal and the second vertical synchronization signal as the third vertical synchronization signal in response to the flag signal from the determining unit, and a second multiplexer for selecting one of the first period of the first vertical synchronization signal and the second period of the second vertical synchronization signal as the third period of the third vertical synchronization signal, in response to the flag signal from the determining unit.

The first multiplexer may select the first vertical synchronization signal and the second multiplexer selects the first period of the first vertical synchronization signal when the second difference satisfies the first threshold range of the first determining unit or does not satisfies the second threshold range of the first determining unit, and the first multiplexer may select the second vertical synchronization signal and the second multiplexer selects the second period of the second vertical synchronization signal when the second difference does not satisfies the first threshold range of the first determining unit or satisfies the second threshold range of the first determining unit.

The first determining unit may determine whether the second difference is within the first threshold range set by a preset minimum threshold value and a preset maximum threshold value, and the second determining unit may determine whether an absolute value of the second difference is equal to the minimum threshold value or is greater than the maximum threshold value.

The flag signal from the second determining unit may be preferentially supplied to the first and second multiplexers when the first and second vertical synchronization signals synchronize with each other.

In another aspect of the present invention, a method of driving a backlight driver includes generating a second vertical synchronization signal based on an input first vertical synchronization signal, and selecting one of the first vertical synchronization signal and the second vertical synchronization signal to output as a third vertical synchronization signal according to whether a period difference between adjacent first vertical synchronization signals satisfies a preset threshold range, detecting a duty ratio of an input pulse width modulation (PWM) signal, generating an output PWM signal synchronized with the third vertical synchronization signal and having the duty ratio and outputting the output PWM signal to a backlight unit.

The method may further include detecting and outputting a first period of the first vertical synchronization signal. The outputting of the third vertical synchronization signal may include generating a second period of the second vertical synchronization signal based on the first period of the first vertical synchronization signal and a time difference between the start timings of the first vertical synchronization signal and the second vertical synchronization signal, and selecting one of the first vertical synchronization signal and the second vertical synchronization signal as the third vertical synchronization signal according to a difference between first periods of adjacent first vertical synchronization signals satisfies the preset threshold range, and selecting one of the first period of the first vertical synchronization signal and the second period of the second vertical synchronization signal as a third period of the third vertical synchronization signal.

The outputting of the third vertical synchronization signal may include generating and outputting the second vertical synchronization signal with the second period, detecting a time difference between the start timings of the first vertical synchronization signal and the second vertical synchronization signal, calculating a first difference between the first period of the first vertical synchronization signal and the detected time difference as the second period of the second vertical synchronization signal, calculating and outputting a second difference between the first periods of the adjacent first vertical synchronization signals, determining whether the second difference satisfies a preset threshold range to generate a flag signal, selecting one of the first vertical synchronization signal and the second vertical synchronization signal s the third vertical synchronization signal in response to the flag signal, and selecting one of the first period of the first vertical synchronization signal and the second period of the second vertical synchronization signal as the third period of the third vertical synchronization signal, in response to the flag signal.

The first vertical synchronization signal and the first period of the first vertical synchronization signal may be selected when the second difference satisfies the preset threshold range, and the second vertical synchronization signal and the second period of the second vertical synchronization signal may be selected when the second difference does not satisfies the preset threshold range.

The determining step may include determining whether the second difference is within the preset threshold range set by a preset minimum threshold value and a preset maximum threshold value.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1A:
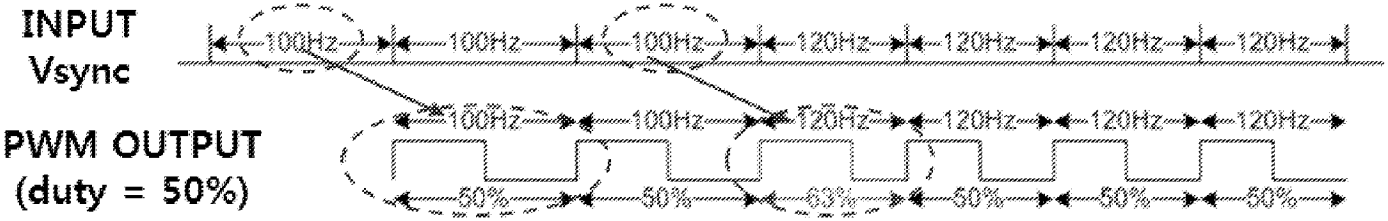
FIG. 1A (Prior Art)
FIGS. 1A and 1B are waveform diagrams showing a conventional process in which a frequency of a pulse width modulation (PWM) signal varies.
Figure 1B:
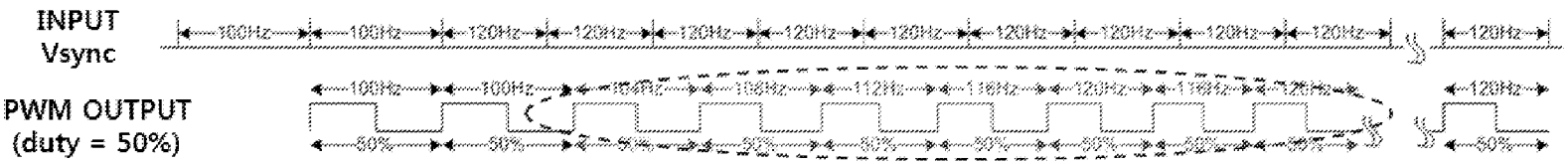
FIG. 1B (Prior Art)
Figure 2:
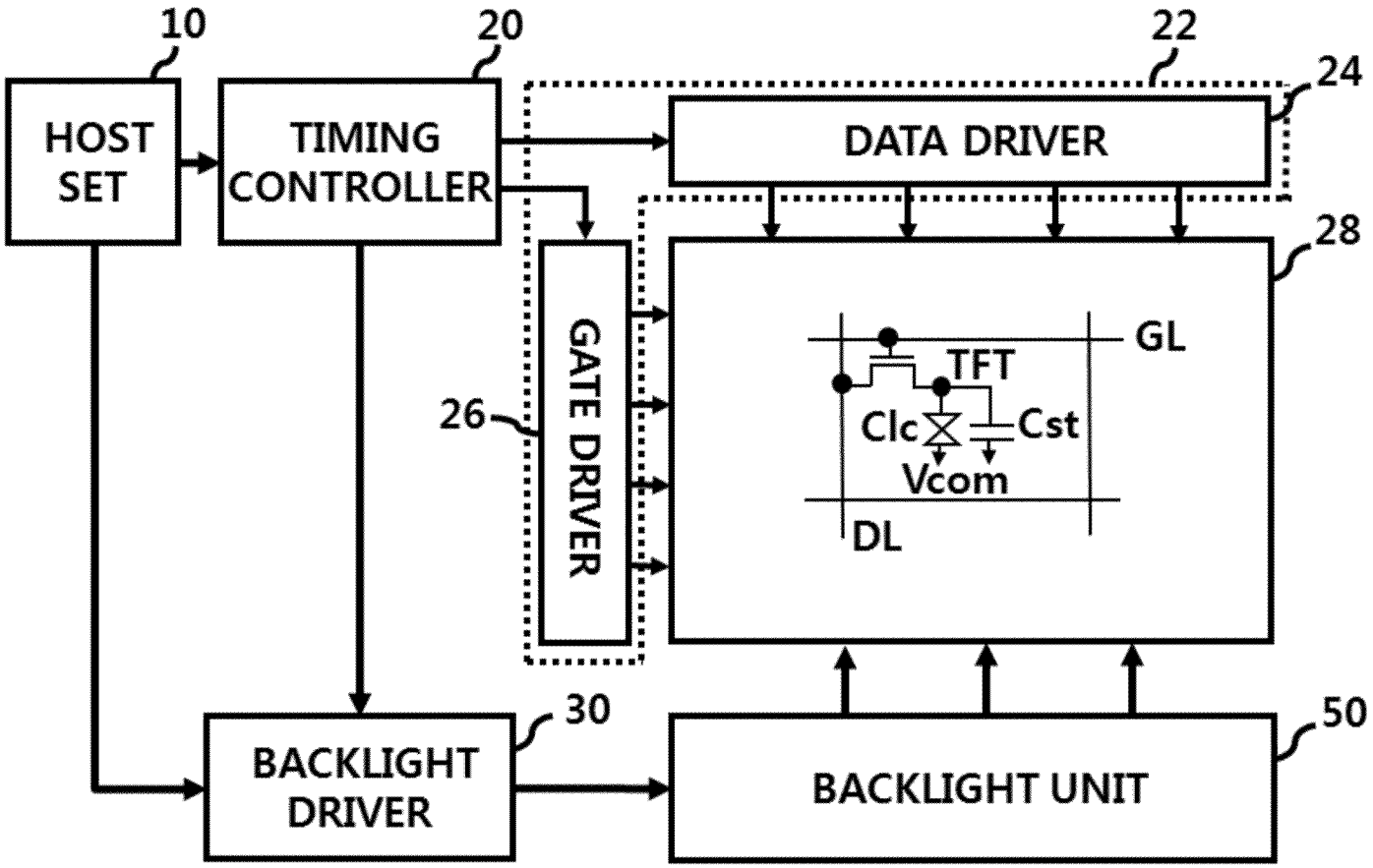
FIG. 2 is a schematic block diagram of a liquid crystal display device including a backlight driver according to an embodiment of the present invention.

FIG. 2 is a schematic block diagram of a liquid crystal display device according to an embodiment of the present invention.

The liquid crystal display device shown in FIG. 2 includes a liquid crystal panel 28, a backlight unit 50, a panel driver 22 including a data driver 24 and a gate driver 26, for driving the liquid crystal panel 28, a backlight driver 30 for driving the backlight unit 50, a timing controller 20 for controlling drive of a panel driver 22 and the backlight driver 30, and a host set connected to the timing controller 20 and the backlight driver 30. Here, the backlight driver 30 may be internally installed in the timing controller 20.

The host set 10 scales image data input from an external source according to resolution of the liquid crystal panel 28 and supplies the image data to the timing controller 20 together with a plurality of synchronization signals. The plurality of synchronization signals include at least a dot clock and a data enable signal and further include a horizontal synchronization signal and a vertical synchronization signal. In addition, the host set 10 supplies a pulse width modulation (PWM) signal having a duty ratio that is preset according to a design value or is set according to user brightness adjustment to the backlight driver 30 or to the backlight driver 30 through the timing controller 20.

The timing controller 20 corrects data input from the host set 10 using various data processing methods for increasing image quality and reducing power consumption to output the data to the data driver 24 of the panel driver 22. For example, in order to a response speed of liquid crystal, the timing controller 20 may apply an overshoot or undershoot value selected from a lookup table according to a data difference between adjacent frames and may correct the input data into overdriving data to output the overdriving data. In addition, in order to increase a contrast ratio or to reduce power consumption, the timing controller 20 may analyze brightness of the input data, may control brightness of the backlight unit 50 according to the brightness analysis result, and may also correct and output the data. When the timing controller 20 controls the brightness of the backlight unit 50, the timing controller 20 may repeat the PWM signal from the host set 10 or may reflect a dimming value based on the brightness analysis result to adjust a duty ratio of the input PWM signal, and may supply the PWM signal of which the duty ratio is adjusted, to the backlight unit 50.

In addition, the timing controller 20 generates a data control signal for control of drive timing of the data driver 24 and a gate control signal for control of drive timing of the gate driver 26 using the plurality of synchronization signals input from the host set 10. When the synchronization signal from the host set 10 includes a dot signal and a data enable signal, the timing controller 20 may generate and use a horizontal synchronization signal and a vertical synchronization signal (hereinafter, referred to as Vsync) via frequency analysis of the input data using the dot clock and the data enable signal. The timing controller 20 supplies the data control signal and the gate control signal to the data driver 24 and the gate driver 26, respectively. The data control signal includes a source start pulse and source sampling clock for controlling latch of a data signal, a polarity control signal for controlling polarity of the data signal, a source output enable signal for controlling an output period of the data signal, and the like. The gate control signal includes a gate start pulse and gate shift clock for control of scanning of a gate signal, a gate output enable signal for control of an output period of the gate signal, and the like. In addition, the timing controller 20 supplies the Vsync to the backlight driver 30 for synchronization of the liquid crystal panel 28 and the backlight unit 50.

The panel driver 22 includes the data driver 24 for driving a data line DL formed on a thin film transistor (TFT) array of the liquid crystal panel 28, and the gate driver 26 for driving a gate line GL formed on the TFT array of the liquid crystal panel 28.

The data driver 24 supplies the image data from the timing controller 20 to a plurality of data lines DL of the liquid crystal panel 28 in response to the data control signal from the timing controller 20. The data driver 24 converts digital data input from the timing controller 20 into a positive/negative analog data signal using a gamma voltage and supplies the data signal to the data line DL whenever each gate line GL is driven. The data driver 24 may include at least one data IC, may be mounted on a circuit film such as a tape carrier package (TCP), a chip on film (COF), a flexible printed circuit (FPC), or the like, and may be attached to the liquid crystal panel 28 using a tape automatic bonding (TAB) method or may be mounted on the liquid crystal panel 28 using a chip on glass (COG) method.

The gate driver 26 sequentially drives gate lines GLs of the liquid crystal panel 28 in response to the gate control signal from the timing controller 20. The gate driver 26 supplies a scan pulse of a gate-on voltage to each gate line GL every corresponding scan period and supplies a gate-off voltage for the remaining period when the other gate lines GLs are driven. The gate driver 26 may include at least one gate IC, may be mounted on a circuit film such as a TCP, a COF, a FPC, or the like, and may be attached to the liquid crystal panel 28 using a TAB method or may be mounted on the liquid crystal panel 28 using a COG method. On the other hand, the gate driver 26 may be formed on a TFT substrate together with the TFT array using the same process and may be internally installed in the liquid crystal panel 28 using a gate in panel (GIP) method.

The liquid crystal panel 28 includes a color filter substrate on which a color filter array is formed, a thin film transistor (TFT) substrate on which a TFT array is formed, a liquid crystal layer between the color filter substrate and the TFT substrate, and polarizing plates attached to external surfaces of the color filter substrate and TFT substrate. The liquid crystal panel 28 displays an image through a pixel matrix on which a plurality of pixels is arranged. Each pixel implements desired color by combinations of red R, green G, and blue B sub-pixels which adjust optical transmittance using variation in liquid crystal arrangement according to a data signal and further includes a white W sub-pixel for enhancement of brightness. Each sub-pixel includes a thin film transistor TFT connected to the gate line GL and the data line DL, and a liquid crystal capacitor Clc and a storage capacitor Cst that are connected in parallel to the thin film transistor TFT. The liquid crystal capacitor Clc is charged with a difference voltage between a voltage of the data signal applied to a pixel electrode through the thin film transistor TFT and a common voltage Vcom applied to a common electrode, and drives liquid crystal according to the charged voltage to adjust optical transmittance. The storage capacitor Cst stably maintains the voltage charged in the liquid crystal capacitor Clc. The liquid crystal layer is driven by a vertical magnetic field, for example, in a twisted nematic (TN) mode or a vertical alignment (VA) mode or by a horizontal magnetic field, for example, in an in-plane switching (IPS) mode or a fringe field switching (FFS) mode.

The backlight unit 50 may use a direct type or edge type backlight including, as a light source, a fluorescent lamp driven by the backlight driver 30, such as a cold cathode fluorescent lamp (CCFL), an external electrode fluorescent lamp (EEFL), or the like, or a light emitting diode (LED). The direct type backlight includes light sources that are arranged over an entire display region so as to face a bottom surface of the liquid crystal panel 28 and a plurality of optical sheets arranged over the light sources, and is configured in such a way that light emitted from the light sources is irradiated to the liquid crystal panel 28 through the plurality of optical sheets. The edge type backlight includes a light guide plate facing the bottom surface of the liquid crystal panel 28, a light source disposed to face at least one edge of the light guide plate, and a plurality of optical sheets disposed on the light guide plate, and is configured in such a way that light emitted from the light source is converted into light of a surface light source and is irradiated to the liquid crystal panel 28 through the plurality of optical sheets.

The backlight driver 30 drives the backlight unit 50 and also controls brightness of the backlight unit 50 in response to a duty ratio of the PWM signal input from the host set 10 or the timing controller 20. When the backlight unit 50 is divided into a plurality of regions and is driven, a plurality of backlight drivers 30 may be used to independently drive the plurality of regions.

The backlight driver 30 uses the Vsync for distinguishing a frame input from the host set 10 or the timing controller 20 in order to drive the backlight unit 50 in synchronization with an image displayed on the liquid crystal panel 28. The backlight driver 30 samples the PWM signal input from the host set 10 or the timing controller 20 to detect a duty ratio of the PWM signal. The backlight driver 30 generates an output PWM signal using the Vsync and the detected duty ratio and drives the backlight unit 50 using the generated output PWM signal.

When the backlight driver 30 filters an input duty ratio detected from an input PWM signal, if the input duty ratio is detected to exceed a preset reference (or a reference range), that is, if the input duty ratio is detected to correspond to an unstable case, the backlight driver 30 may exclude the unstable input duty ratio and may select and output a stable input duty ratio of a previous period, thereby removing the unstable duty ratio.

In particular, the backlight driver 30 generates Vsync2 having a frequency (a period) that varies according to variation in a frequency (a period) of an input Vsync1 and becoming in synchronization with the Vsync1 in order to adaptively correspond to the variation in the frequency of the input Vsync1, selects one of the input Vsync1 and the generated Vsync2 as output Vsync3 according to whether a frequency (period) difference between adjacent Vsync1s satisfies a preset threshold range, and generates a PWM signal having an input duty ratio in synchronization with the Vsync3 to drive the backlight unit 50.

Thus, even if the frequency of the input Vsync1 varies according to an input image, the backlight driver 30 may maintain a constant duty ratio of the output PWM signal using an output Vsync3 in synchronization with the input Vsync1 or the generated Vsync2 as an output Vsync3, thereby preventing both backlight flicker and wavy noise which have a trade-off relationship.

In addition, when the frequency (period) difference between adjacent Vsync1s is within a threshold value, a duty ratio difference due to the frequency (period) difference cannot be recognized, and thus, the Vsync1 may be output as the Vsync3 without an unnecessary calculation process. The threshold value may be obtained by presetting an appropriate range to a corresponding liquid crystal display device through a plurality of experiments by a designer and storing the appropriate range in an internal memory of the liquid crystal display device, and may be updated as necessary.

The backlight driver 30 may have a delay time of about at least one frame (one period) between the input Vsync1 and the generated Vsync2.

Figure 3:
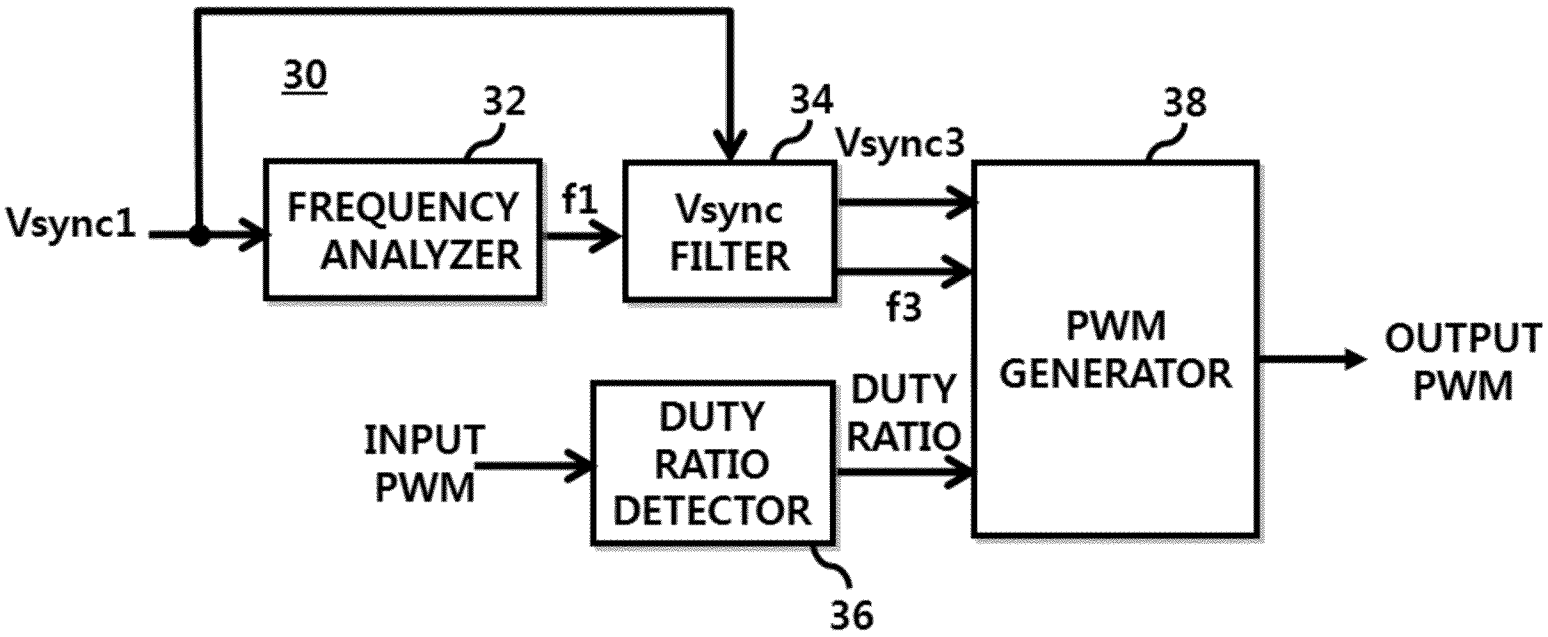
FIG. 3 is a block diagram of an internal structure of the backlight driver shown in FIG. 2.
Figure 4:
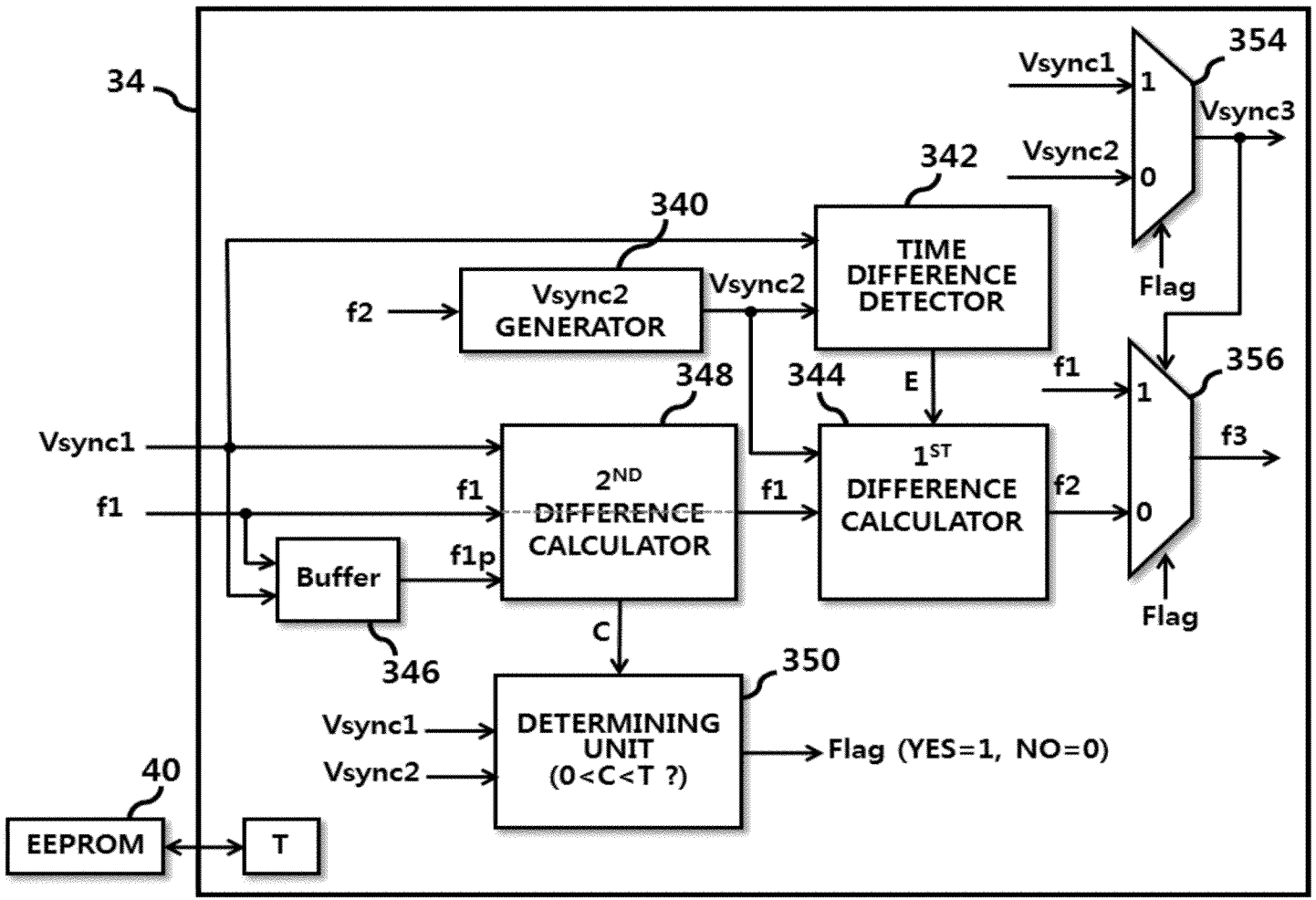
FIG. 4 is a block diagram of an internal structure of a vertical synchronization signal (Vsync) filter shown in FIG. 3.

FIG. 3 is a block diagram of an internal structure of the backlight driver 30 shown in FIG. 2, and FIG. 4 is a block diagram of an internal structure of a Vsync filter 34 of the backlight driver 30 shown in FIG. 3.

The backlight driver 30 shown in FIG. 3 includes a frequency analyzer 32 for analyzing a frequency of the input Vsync1 to detect and output a period f1, the Vsync filter 34 for filtering the input Vsync1 and the period f1 of the Vsync1 from the frequency analyzer 32 to output the Vsync3 and a period f3 thereof, a duty ratio detector 36 for sampling and counting an input PWM signal to detect an input duty ratio, and a PWM generator 38 for generating an output PWM signal having the duty ratio from the duty ratio detector 36 using the Vsync3 and the period f3 thereof from the Vsync filter 34 to output the output PWM signal to the backlight unit 50.

The frequency analyzer 32 analyzes the frequency of the Vsync1 input from the host set 10 or the timing controller 20 to detect and output the period f1 of the input Vsync1 every frame (period).

The Vsync filter 34 filters the Vsync1 to generate the Vsync2 every frame in order to adaptively correspond to variation in the frequency of the input Vsync1, and selects one of the input Vsync1 and the generated Vsync2 to output the Vsync3 according to whether a frequency (period) difference between adjacent input Vsync1s satisfies a preset condition.

In other words, the Vsync filter 34 generates a Vsync2 based on the input Vsync1 every frame. In this case, the Vsync filter 34 generates the period f2 of the Vsync2 based on the period f1 of the input Vsync1 according to a time difference between the input Vsync1 and the generated Vsync2. In addition, the Vsync filter 34 calculates a period difference between adjacent Vsync1s in synchronization with the Vsync1 and the Vsync2, selects one of the Vsync1 and the Vsync2 to output the Vsync3 according to the calculated period difference is within a preset threshold value, and also selects one of the period f1 of the input Vsync1 and the period f2 of the generated Vsync2 as the period f3 of the Vsync3.

The duty ratio detector 36 samples the PWM signal input from the host set 10 or the timing controller 20 to detect the input duty ratio. The duty ratio detector 36 detects each period of the input PWM signal and also detects a high pulse width of each period by sampling and counting the input PWM signal using an internal clock. In addition, the duty ratio detector 36 calculates a ratio of the high pulse width to the period detected per period as a percentage to detect and output the input duty ratio every period of the input PWM signal.

The PWM generator 38 generates and outputs the PWM signal according to the duty ratio from the duty ratio detector 36 using the Vsync3 and the period f3 thereof from the Vsync filter 34. For example, the PWM generator 38 generates an internal clock based on the period f3 of the Vsync3 from the Vsync filter 34 and then generates the PWM signal having a duty ratio using the internal clock to output teh PWM signal to the backlight unit 50.

FIG. 4 is a block diagram of an internal structure of the Vsync filter 34 shown in FIG. 3.

The Vsync filter 34 of FIG. 4 includes: a Vsync2 generator 340 for generating the generated Vsync2 with the period f2; a time difference detector 342 for detecting a time difference E between the start timings of the input Vsync1 and the Vsync2 from the Vsync2 generator 340; a first difference calculator 344 for calculating a difference (f1−E=f2) between the period f1 of the input Vsync1 and the time difference E from the time difference detector 342 to output the period f2 of the Vsync2; a second difference calculator 348 for calculating and outputting a difference (f1−f1p=C) between a current period f1 of the input Vsync1 and a previous period f1p supplied from a buffer 346; a determining unit 350 for determining whether the difference (C) from the second difference calculator 348 is within a threshold range to generate a flag signal in synchronization with the Vsync1 or Vsync2; a first multiplexer 354 (hereinafter, referred to as the MUX1 354) for selecting one of the Vsync1 and the Vsync2 as the Vsync3 in response to the flag signal from the determining unit 350; and a second multiplexer 356 (hereinafter, referred to as the MUX2 356) for selecting one of the period f1 of the Vsync1 and the period f2 of the Vsync2 as the period f3 of the Vsync3 in response to the flag signal.

The Vsync2 generator 340 generates and outputs the Vsync2 having a period f2 supplied from the first difference calculator 344.

The time difference detector 342 detects the time difference E between the start timings of the input Vsync1 and the Vsync2 from the Vsync2 generator 340 to output the detected time difference E. In other words, the time difference detector 342 detects the time difference E from a start timing of the input Vsync1 to a start timing of the Vsync2 to output the time difference E.

The first difference calculator 344 calculates the difference (f1−E=f2) between the current period f1 of the input Vsync1 and the time difference E from the time difference detector 342 to output a period f2 of the next Vsync2.

The second difference calculator 348 calculates and outputs the difference C between periods of the adjacent input Vsync1s. In other words, the second difference calculator 348 calculates and outputs the difference (|f1−f1p|=C) between the current period f1 of the input Vsync1 and the previous period f1p supplied from the buffer 346.

The determining unit 350 determines whether the difference C supplied from the second difference calculator 348, that is, the difference C between the periods of the adjacent Vsync1s is within a preset threshold range (0<C<T) to generate a flag signal in synchronization with the Vsync1 or Vsync2. When the difference C between the periods of the adjacent Vsync1s is within the threshold range (0<C<T) (YES), the determining unit 350 generates a flag signal "1". On the other hand, when the difference C between the periods of the adjacent Vsync1s is not within the threshold range (0<C<T) (NO), the determining unit 350 generates a flag signal "0".

The MUX1 354 selects one of the Vsync1 and the Vsync2 as the Vsync3 in response to the flag signal from the determining unit 350. When the flag signal from the determining unit 350 is "1", the MUX1 354 selects the Vsync1 as the Vsync3. When the flag signal from the determining unit 350 is "0", the MUX1 354 selects the Vsync2 as the Vsync3.

The MUX2 356 selects one of the period f1 of the Vsync1 and the period f2 of the Vsync2 as the period f3 of the Vsync3, in response to the flag signal from the determining unit 350. When the flag signal from the determining unit 350 is "1"), the MUX1 356 selects the period f1 of the Vsync1 as the period f3 of the Vsync3. When the flag signal from the determining unit 350 is "0", the MUX1 356 selects the period f2 of the Vsync2 as the period f3 of the Vsync3.

The threshold value T for determining the threshold range set by the first determining units 350 is preset according to a corresponding liquid crystal display device by a designer and is stored in an EEPROM 40 that is an internal memory of the liquid crystal display device. The host set 10 may update the threshold value T stored in the EEPROM 40 to a desired value, that is, an intended value of the host set 10 via I2C communication, thereby increasing a freedom degree of adjustment of the threshold value T.

The threshold value T is set for this reason. When a period difference between adjacent input Vsync1s is equal to or less than a recognizable level, a duty ratio distorted due to the period difference is not large, and thus, is not recognized, thereby preventing unnecessary processes such as a process in which the generated Vsync2 is used.

Figure 5:
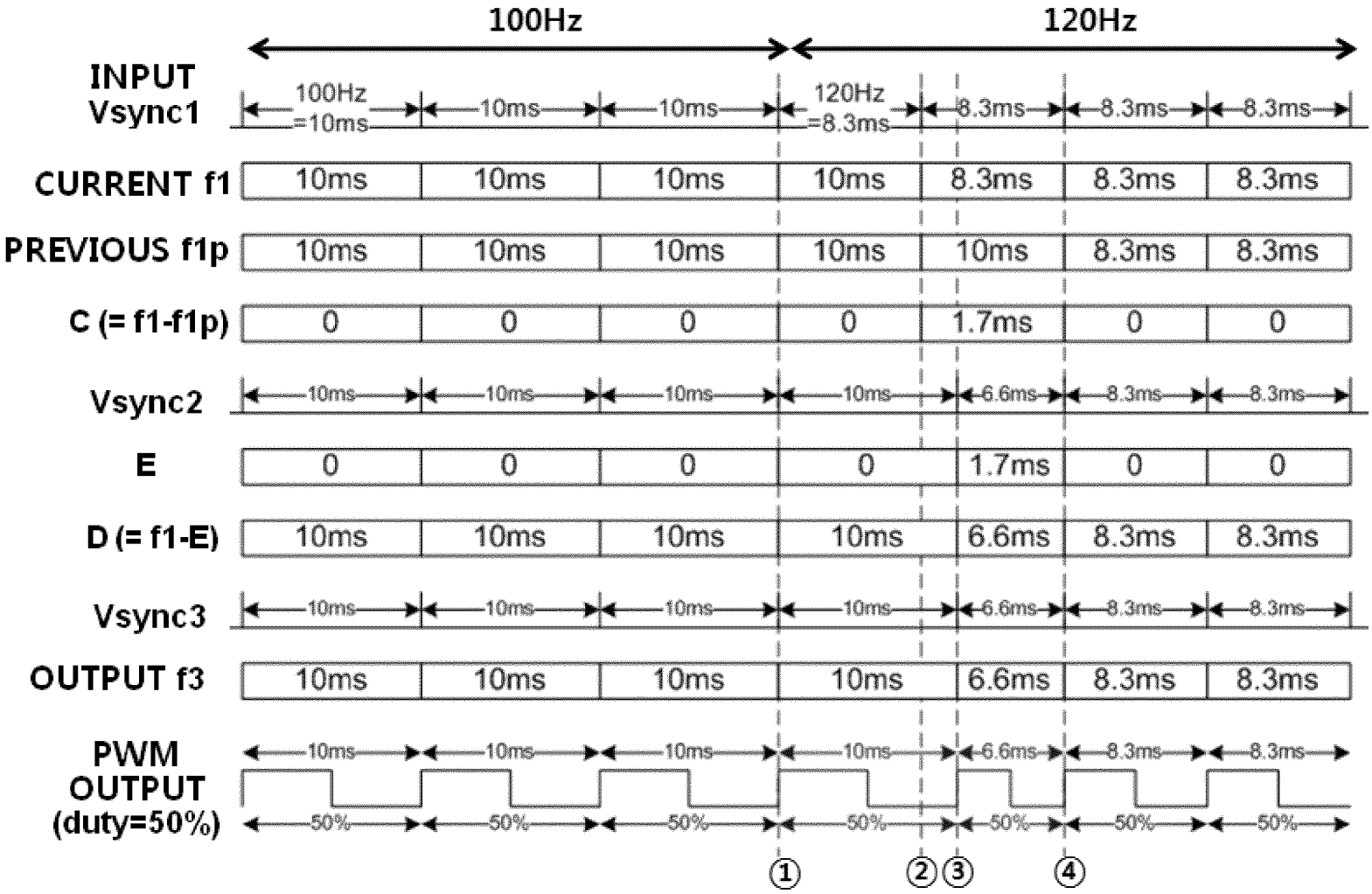
FIG. 5 is a diagram showing a PWM signal output and a filtering process of the Vsync filter shown in FIG. 4 when a frequency of an input Vsync1 increases and a difference between periods of adjacent input Vsync1s is greater than a maximum threshold value.

FIG. 5 is a diagram showing a PWM signal output and a filtering process of the Vsync filter 34 shown in FIG. 4 when a frequency of the input Vsync1 increases and the absolute value of difference C between the periods of the adjacent input Vsync1s is greater than the maximum threshold value T.

In general, when a period difference between a current frame and a previous frame is equal to or less than 1 ms, flick is not recognizable, and thus, the maximum threshold value T may be set to 1 ms. FIG. 5 shows a case in which a frequency of the input Vsync1 increases from 100 Hz to 120 Hz.

At a time ① in FIG. 5, a period f1 of a current Vsync1 is 10 ms and a period f1p of previous Vsync1 is 10 ms, and thus, a difference C therebetween is 0 ms. In addition, a start timing of the Vsync1 and a start timing of a generated Vsync2 are identical, and thus, a time difference E is 0. Thus, a difference f2 between the period f1 of the Vsync1 and the time difference E is 10 ms. Since the difference C is 0, a flag signal is 0. Accordingly, the generated Vsync2 is output as an output Vsync3, and a period f2 of the generated Vsync2 is output as a period f3 of the output Vsync3.

At a time ② in FIG. 5, the period f1 of the current Vsync1 is 8.3 ms and the period f1p of the previous Vsync1 is 10 ms, and thus, a difference C therebetween is 1.7 ms. In addition, the next Vsync2 has not started at the start timing of the Vsync1, yet, and thus, the time difference E is not updated and is still 0. Thus, the difference f2 between the period f1 of the Vsync1 and the time difference E is still 10 ms. Since the absolute value of difference C is 1.7 ms, which is greater than the threshold value T (1 ms), a flag signal is 0. Accordingly, the current Vsync2 is output as an output Vsync3. However, the output Vsync3 is in a low state, and thus, the period f3 of the output Vsync3 is not updated and is held at a previous value.

At a time ③ in FIG. 5, the period f1 of the current Vsync1 is 8.3 ms and the period f1p of the previous Vsync1 is 10 ms, and thus, a difference C therebetween is 1.7 ms. In addition, the time difference E is 1.7 ms, which is a time difference between the start timing of the current Vsync2 and the start timing of the current Vsync1. Thus, the difference f2 between the period f1 of the Vsync1 and the time difference E is 6.6 ms. Since the difference C is 1.7 ms, which is greater than the threshold value T, that is, 1 ms, a flag signal is 0. Accordingly, the generated Vsync2 is output as an output Vsync3, and the period f2 of the generated Vsync2 is output as the period f3 of the output Vsync3.

At a time ④ in FIG. 5, the period f1 of the current Vsync1 is 8.3 ms and the period f1p of the previous Vsync1 is 8.3 ms, and thus, a difference C therebetween is 0 ms. In addition, the start timing of the Vsync1 and the start timing of a current Vsync2 are identical, and thus, the time difference E is 0. Thus, a difference f2 between the period f1 of the Vsync1 and the time difference E is 8.3 ms. Since the difference C is 0, a flag signal is 0. Accordingly, the current Vsync2 is output as an output Vsync3, and the period f2 of the generated Vsync2 is output as the period f3 of the output Vsync3.

The table 1 listed below shows all the values during the process of FIG. 5.

TABLE 1

FIG. 5

| | Time ① | Time ② | Time ③ | Time ④ |
|---|---|---|---|---|
| input Vsync1 (period) | 10→8.3 | 8.3 | 8.3 | 8.3 |
| f1 | 10 | 8.3 | 8.3 | 8.3 |
| f1p | 10 | 10 | 10 | 8.3 |
| C = \|f1 − f1p\| | 0 | 1.7 | 1.7 | 0 |
| Vsync2 (period) | 10 | 10 | 6.6 | 8.3 |
| E | 0 | 0 | 1.7 | 0 |
| D = f1 − E | 10 | 10 | 6.6 | 8.3 |
| flag signal | 0 | 0 | 0 | 0 |
| Vsync3 | Vsync2 | Vsync2 | Vsync2 | Vsync2 |
| f3 | f2 | f2 | f2 | f2 |

Thus, it may be seen that, when a frequency of an input Vsync1 increases and the difference C between periods of adjacent input Vsync1s is greater than the threshold value T, the generated Vsync2 and the period f2 thereof are output as the output Vsync3 and the period f3 thereof by filtering the Vsync1, thereby obtaining an output of a PWM signal that maintains a duty ratio 50% with the Vsync1 and the Vsync2 in synchronization with each other.

Figure 6:
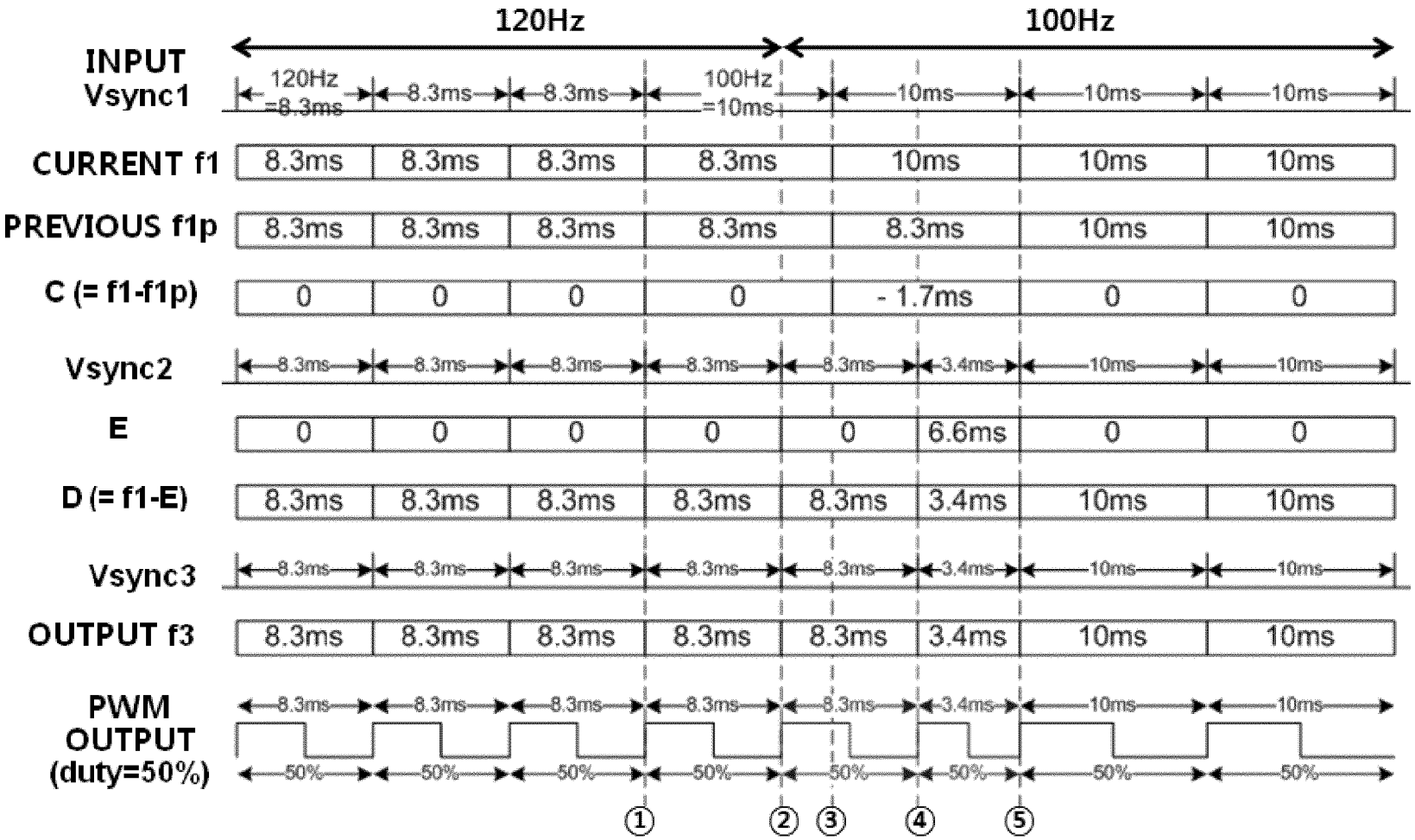
FIG. 6 is a diagram showing a PWM signal output and a filtering process of the Vsync filter shown in FIG. 4 when a frequency of an input Vsync1 reduces and a difference between periods of adjacent input Vsync1s is greater than a maximum threshold value.

FIG. 6 is a diagram showing a PWM signal output and a filtering process of the Vsync filter 34 shown in FIG. 4 when a frequency of the input Vsync1 reduces and the difference C between the periods of the adjacent input Vsync1s is greater than the maximum threshold value T.

FIG. 6 shows a case in which a frequency of the input Vsync1 decreases from 120 Hz to 100 Hz and the maximum threshold value T is set to 1 ms.

At a time ① in FIG. 6, a period f1 of a current Vsync1 is 8.3 ms and a period f1p of the previous Vsync1 is 8.3 ms, and thus, a difference C therebetween is 0 ms. In addition, a start timing of the Vsync1 and a start timing of a current Vsync2 are identical, and thus, a time difference E is 0. Thus, a difference f2 between the period f1 of the Vsync1 and the time difference E is 8.3 ms. Since the difference C is 0, a flag signal is 0. Accordingly, the generated Vsync2 is output as an output Vsync3, and a period f2 of the generated Vsync2 is output as a period f3 of the output Vsync3.

At a time ② in FIG. 6, the period f1 of the current Vsync1 is 8.3 ms and the period f1p of the previous Vsync1 is 8.3 ms, and thus, a difference C therebetween is 0 ms. In addition, a new Vsync2 is generated at the time ②, but the input Vsync1 is not input, and thus, the time difference E is not updated and is 0. Thus, the difference f2 between the period f1 of the Vsync1 and the time difference E is still 8.3 ms. The difference C is 0, and thus, a flag signal is 0. Accordingly, the current Vsync2 is output as an output Vsync3 and the period f2 of the current Vsync2 is output as the period f3 of the output Vsync3.

At a time ③ in FIG. 6, the period f1 of the current Vsync1 is 10 ms and the period f1p of the previous Vsync1 is 8.3 ms, and thus, a difference C therebetween is 1.7 ms. In addition, a new Vsync2 has not been generated at the start timing of the Vsync1, and thus, the time difference E is not updated and is still 0. Thus, the difference f2 between the period f1 of the Vsync1 and the time difference E is still 8.3 ms. Since the difference C is −1.7 ms, which is less than 0, a flag signal is 0. Accordingly, the current Vsync2 is output as an output Vsync3. However, the output Vsync3 is in a low state, and thus, the period f3 of the output Vsync3 is not updated and is held at a previous value.

At a time ④ in FIG. 6, the period f1 of the current Vsync1 is 10 ms and the period f1p of the previous Vsync1 is 8.3 ms, and thus, a difference C therebetween is −1.7 ms. In addition, the time difference E is 6.6 ms, which is a time difference between the start timing of the Vsync2 and the start timing of the Vsync1. Thus, the difference f2 between the period f1 of the Vsync1 and the time difference E is 3.4 ms. Since the difference C is 1.7 ms, which is greater than the threshold value T, that is, 1 ms, a flag signal is 0. Accordingly, the current Vsync2 is output as an output Vsync3, and the period f2 of the generated Vsync2 is output as the period f3 of the output Vsync3.

At a time ⑤ in FIG. 6, the period f1 of the current Vsync1 is 10 ms and the period f1p of the previous Vsync1 is 10 ms, and thus, a difference C therebetween is 0 ms. In addition, the start timing of the Vsync1 and the start timing of a generated Vsync2 are identical, and thus, the time difference E is 0. Thus, a difference f2 between the period f1 of the Vsync1 and the time difference E is 10 ms. Since the difference C is 0, a flag signal is 0. Accordingly, the generated Vsync2 is output as an output Vsync3, and the period f2 of the generated Vsync2 is output as the period f3 of the output Vsync3.

The table 2 listed below shows all the values during the process of FIG. 6.

TABLE 2

FIG. 6

| | Time ① | Time ② | Time ③ | Time ④ | Time ⑤ |
|---|---|---|---|---|---|
| input Vsync1 (period) | 8.3→10 | 10 | 10 | 10 | 10 |
| f1 | 8.3 | 8.3 | 10 | 10 | 10 |
| f1p | 8.3 | 8.3 | 8.3 | 8.3 | 10 |
| C = \|f1 − f1p\| | 0 | 0 | 1.7 | 1.7 | 0 |
| Vsync2 (period) | 8.3 | 8.3 | 8.3 | 3.4 | 10 |
| E | 0 | 0 | 0 | 6.6 | 0 |
| D = f1 − E | 8.3 | 8.3 | 8.3 | 3.4 | 10 |
| flag signal | 0 | 0 | 0 | 0 | 0 |
| Vsync3 | Vsync2 | Vsync2 | Vsync2 | Vsync2 | Vsync2 |
| f3 | f2 | f2 | f2 | f2 | f2 |

Thus, it may be seen that, when a frequency of an input Vsync1 reduces and the difference C between periods of adjacent input Vsync1s is greater than the threshold value T, the current Vsync2 and the period f2 thereof are output as the output Vsync3 and the period f3 thereof by filtering the Vsync1, thereby obtaining an output of a PWM signal that maintains a duty ratio 50% with the Vsync1 and the Vsync2 in synchronization with each other.

Figure 7:
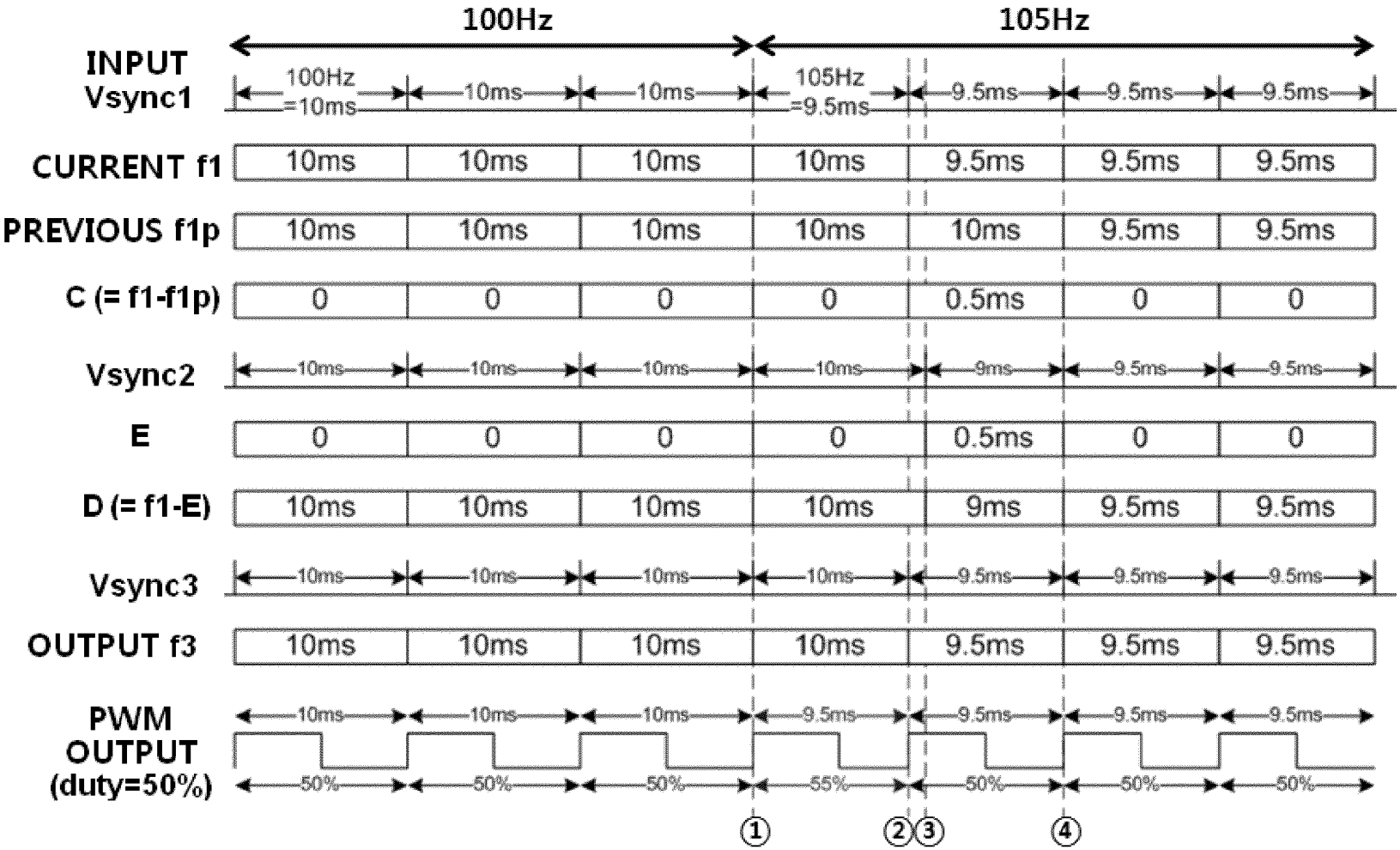
FIG. 7 is a diagram showing a PWM signal output and a filtering process of the Vsync filter shown in FIG. 4 when a frequency of an input Vsync1 increases and a difference between periods of adjacent input Vsync1s is less than a maximum threshold value.

FIG. 7 is a diagram showing a PWM signal output and a filtering process of the Vsync filter 34 shown in FIG. 4 when a frequency of the input Vsync1 increases and the difference C between the periods of the adjacent input Vsync1s is less than the maximum threshold value T.

FIG. 7 shows a case in which a frequency of the input Vsync1 increases from 100 Hz to 105 Hz and the maximum threshold value T is set to 1 ms.

At a time ① in FIG. 7, a period f1 of a current Vsync1 is 10 ms and a period f1p of the previous Vsync1 is 10 ms, and thus, a difference C therebetween is 0 ms. In addition, a start timing of the Vsync1 and a start timing of a generated Vsync2 are identical, and thus, a time difference E is 0. Thus, a difference f2 between the period f1 of the Vsync1 and the time difference E is 10 ms. Since the difference C is 0, a flag signal is 0. Accordingly, the generated Vsync2 is output as an output Vsync3, and a period f2 of the generated Vsync2 is output as a period f3 of the output Vsync3.

At a time ② in FIG. 7, the period f1 of the current Vsync1 is 9.5 ms and the period f1p of the previous Vsync1 is 10 ms, and thus, a difference C therebetween is 0.5 ms. In addition, a new Vsync2 has not started at the start timing of the Vsync1, and thus, the time difference E is not updated and is still 0. Thus, the difference f2 between the period f1 of the Vsync1 and the time difference E is 9.5 ms. Since the difference C is 0.5 ms, which is less than the threshold value T, that is, 1 ms and is greater than 0, a flag signal is 1. Accordingly, the generated Vsync2 is output as an output Vsync3, and the period f2 of the current Vsync2 is output as a period f3 of the output Vsync3.

At a time ③ in FIG. 7, the period f1 of the current Vsync1 is 9.5 ms and the period f1p of the previous Vsync1 is 10 ms, and thus, a difference C therebetween is 0.5 ms. In addition, the time difference E is 0.5 ms, which is a time difference between the start timing of the current Vsync2 and the start timing of the Vsync1. Thus, the difference f2 between the period f1 of the Vsync1 and the time difference E is 9 ms. An absolute value of the difference C is 0.5 ms, which is less than the threshold value T, that is, 1 ms, and thus, a flag signal is 1. Thus, the input Vsync1 is output as the output Vsync3. However, the output Vsync3 is in a low state, and thus, the period f3 of the output Vsync3 is not updated and is held at a previous value.

At a time ④ in FIG. 7, the period f1 of the current Vsync1 is 9.5 ms and the period f1p of the previous Vsync1 is 9.5 ms, and thus, a difference C therebetween is 0 ms. In addition, the start timing of the Vsync1 and the start timing of a current Vsync2 are identical, and thus, the time difference E is 0. Thus, a difference f2 between the period f1 of the Vsync1 and the time difference E is 9.5 ms. Since the difference C is 0, a flag signal is 0. Accordingly, the current Vsync2 is output as an output Vsync3, and the period f2 of the generated Vsync2 is output as the period f3 of the output Vsync3.

The table 3 listed below shows all the values during the process of FIG. 7.

TABLE 3

| FIG. 7 | | | | |
|---|---|---|---|---|
| | Time ① | Time ② | Time ③ | Time ④ |
| input Vsync1 (period) | 10→9.5 | 9.5 | 9.5 | 9.5 |
| f1 | 10 | 9.5 | 9.5 | 9.5 |
| f1p | 10 | 10 | 10 | 9.5 |
| C = \|f1 − f1p\| | 0 | 0.5 | 0.5 | 0 |
| Vsync2 (period) | 10 | 10 | 9 | 9.5 |
| E | 0 | 0 | 0.5 | 0 |
| D = f1 − E | 10 | 9.5 | 9 | 9.5 |
| flag signal | 0 | 1 | 1 | 0 |

TABLE 3-continued

| FIG. 7 | | | | |
|---|---|---|---|---|
| | Time ① | Time ② | Time ③ | Time ④ |
| Vsync3 | Vsync2 | Vsync2 | Vsync1 | Vsync2 |
| f3 | f2 | f2 | f2 | f2 |

Thus, it may be seen that, when a frequency of an input Vsync1 increases and the difference C between periods of adjacent input Vsync1s is within a threshold range, the Vsync1 and the period f1 thereof are output as the output Vsync3 and the period f3 thereof, thereby obtaining an output of a PWM signal that has a duty ratio difference that is equal to a recognizable level or less or maintains a duty ratio 50% in synchronization with the Vsync1.

Figure 8:
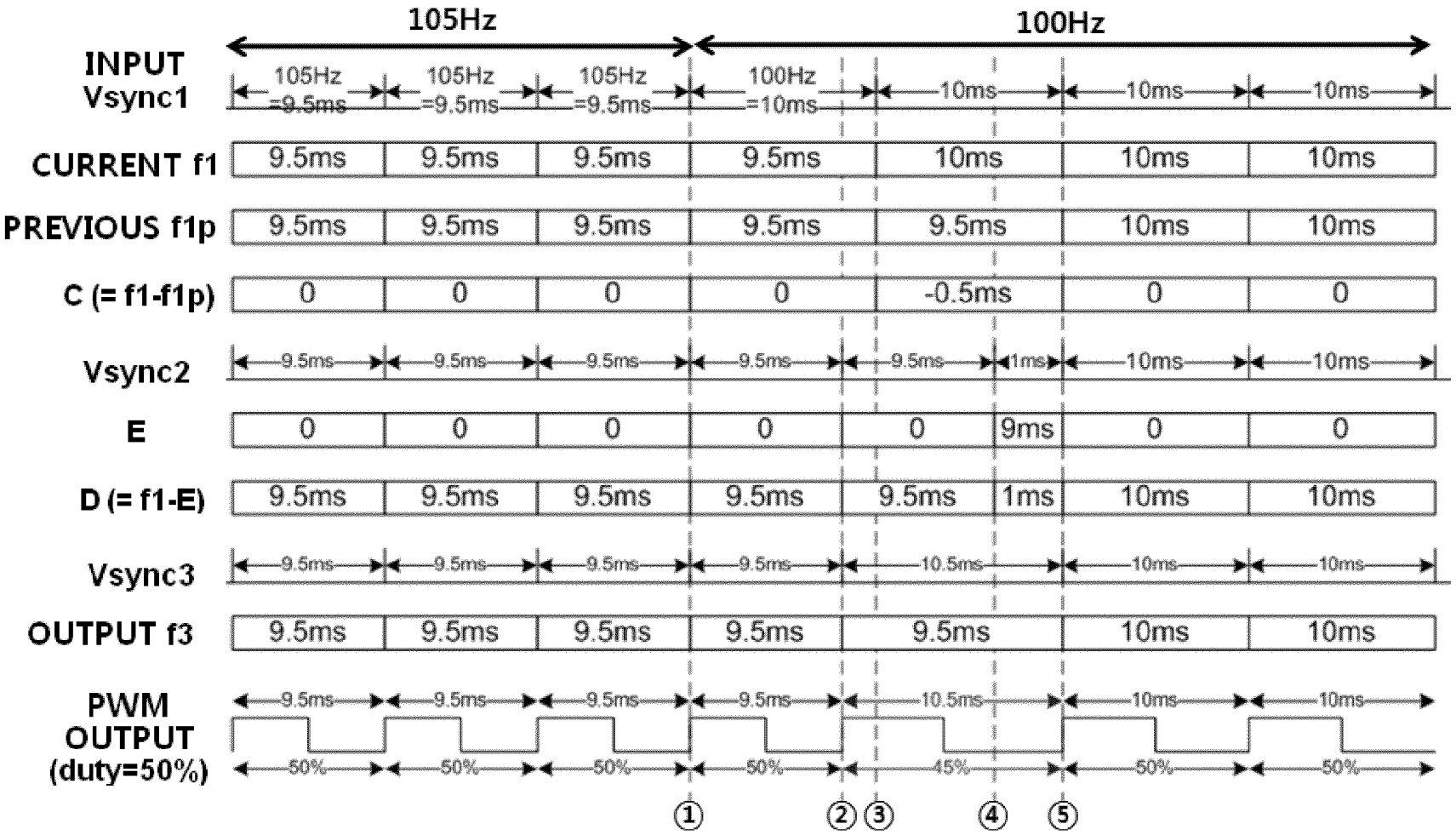
FIG. 8 is a diagram showing a PWM signal output and a filtering process of the Vsync filter shown in FIG. 4 when a frequency of an input Vsync1 reduces and a difference between periods of adjacent input Vsync1s is less than a maximum threshold value.

FIG. 8 is a diagram showing a PWM signal output and a filtering process of the Vsync filter 34 shown in FIG. 4 when a frequency of the input Vsync1 reduces and the difference C between the periods of the adjacent input Vsync1s is less than the maximum threshold value T.

FIG. 8 shows a case in which a frequency of the input Vsync1 reduces from 105 Hz to 100 Hz and the maximum threshold value T is set to 1 ms.

At a time ① in FIG. 8, a period f1 of a current Vsync1 is 9.5 ms and a period f1p of the previous Vsync1 is 9.5 ms, and thus, a difference C therebetween is 0 ms. In addition, a start timing of the Vsync1 and a start timing of a new Vsync2 are identical, and thus, a time difference E is 0. Thus, a difference f2 between the period f1 of the Vsync1 and the time difference E is 9.5 ms. Since the difference C is 0, a flag signal is 0. Accordingly, the new Vsync2 is output as an output Vsync3, and a period f2 of the new Vsync2 is output as a period f3 of the output Vsync3.

At a time ② in FIG. 8, the period f1 of the current Vsync1 is 9.5 ms and the period f1p of the previous Vsync1 is 9.5 ms, and thus, a difference C therebetween is 0 ms. In addition, a new Vsync2 is generated at the time ②, but a new Vsync1 is not input, and thus, the time difference E is not updated and is 0. Thus, the difference f2 between the period f1 of the Vsync1 and the time difference E is still 9.5 ms. An absolute value of the difference C is 0, and thus, a flag signal is 0. Accordingly, the generated Vsync2 is output as an output Vsync3 and the period f2 of the current Vsync2 is output as the period f3 of the output Vsync3 in synchronization with the output Vsync3.

At a time ③ in FIG. 8, the period f1 of the current Vsync1 is 10 ms and the period f1p of the previous Vsync1 is 9.5 ms, and thus, a difference C therebetween is 0.5 ms. In addition, a new Vsync2 has not generated at the start timing of the Vsync1, and thus, the time difference E is not updated and is still 0. Thus, the difference f2 between the period f1 of the Vsync1 and the time difference E is still 9.5 ms. Since the difference C is 0.5 ms, which is less than 0, a flag signal is 0. Accordingly, the current Vsync2 is output as an output Vsync3. However, the output Vsync3 is in a low state, and thus, the period f3 of the output Vsync3 is not updated and is held at a previous value.

At a time ④ in FIG. 8, the period f1 of the current Vsync1 is 10 ms and the period f1p of the previous Vsync1 is 9.5 ms, and thus, a difference C therebetween is −0.5 ms. In addition, the time difference E is 9 ms, which is a time difference between the start timing of the current Vsync2 and the start timing of the Vsync1. Thus, the difference f2 between the period f1 of the Vsync1 and the time difference E is 1 ms. The difference C is 0.5 ms, which is less than the threshold value T, that is, 1 ms, and thus, a flag signal is 1. Thus, the input Vsync1 is output as an output Vsync3. However, the output Vsync3 is in a low state, and thus, the period f3 of the output Vsync3 is not updated and is held at a previous value.

At a time ⑤ in FIG. 8, the period f1 of the current Vsync1 is 10 ms and the period ftp of the previous Vsync1 is 10 ms, and thus, a difference C therebetween is 0 ms. In addition, the start timing of the Vsync1 and the start timing of a current Vsync2 are identical, and thus, the time difference E is 0. Thus, a difference f2 between the period f1 of the Vsync1 and the time difference E is 10 ms. Since the difference C is 0, a flag signal is 0. Accordingly, the generated Vsync2 is output as an output Vsync3, and the period f2 of the current Vsync2 is output as the period f3 of the output Vsync3.

The table 4 listed below shows all the values during the process of FIG. 8.

TABLE 4

FIG. 8

| | Time ① | Time ② | Time ③ | Time ④ | Time ⑤ |
|---|---|---|---|---|---|
| input Vsync1 (period) | 9.5→10 | 10 | 10 | 10 | 10 |
| f1 | 9.5 | 9.5 | 10 | 10 | 10 |
| f1p | 9.5 | 9.5 | 9.5 | 9.5 | 10 |
| C = \|f1 − f1p\| | 0 | 0 | 0.5 | 0.5 | 0 |
| Vsync2 (period) | 9.5 | 9.5 | 9.5 | 1 | 10 |
| E | 0 | 0 | 0 | 9 | 0 |
| D = f1 − E | 9.5 | 9.5 | 9.5 | 1 | 10 |
| flag signal | 0 | 0 | 0 | 1 | 0 |
| Vsync3 | Vsync2 | Vsync2 | Vsync2 | Vsync1 | Vsync2 |
| f3 | f2 | f2 | f2 | f2 | f2 |

Thus, it may be seen that, when a frequency of an input Vsync1 reduces and the difference C between periods of adjacent input Vsync1s is within a threshold range, the Vsync1 and the period f1 thereof are output as the output Vsync3 and the period f3 thereof, thereby obtaining an output of a PWM signal that has a duty ratio difference of 5% that is equal to a recognizable level or less or maintains a duty ratio 50% in synchronization with the Vsync1.

As described above, a backlight driver and a method of driving the same according to the present invention generate the Vsync2, every frame, based on the input Vsync1, and use a time difference between the Vsync1 and the Vsync2 to generate a period of Vsync2 in order to adaptively correspond to variation of a frequency of the input Vsync1. In addition, the backlight driver and the method of driving the same select one of the input Vsync1 and the generated Vsync2 according to whether a frequency (period) difference between adjacent input Vsync1s satisfies a preset threshold range as the output Vsync3, also select one of a frequency (period) of the input Vsync1 and a frequency (period) of the generated Vsync2 as a frequency (period) of the output Vsync3, and generate and output a PWM signal based on an input duty ratio using the output Vsync3. Thus, even if the frequency of the input Vsync1 varies, a constant duty ratio of the output PWM signal may be maintained using the output Vsync3 in synchronization with the input Vsync1 or the generated Vsync2, thereby preventing both backlight flicker and wavy noise that have a trade-off relationship.

In addition, when the frequency (period) difference between adjacent Vsync1s is within a threshold range, a duty ratio difference due to the period difference cannot be recognized, and thus, the Vsync1 may be directly output as the Vsync3.

According to the present invention, a backlight driver and a method of driving the same generates a second vertical synchronization signal having a frequency that is based on variation in a frequency of an input first vertical synchronization signal, selects one of the first vertical synchronization signal and the second vertical synchronization signal as a third vertical synchronization signal according to whether a period difference between adjacent first vertical synchronization signals satisfies a preset threshold range, and generate a PWM signal having an input duty ratio in synchronization with the second vertical synchronization signal to drive a backlight.

Thus, in the backlight driver and the method of driving the same according to the present invention, even if the frequency of the input first vertical synchronization signal varies, a constant duty ratio of the output PWM signal may be maintained using the output third vertical synchronization signal based on the input first vertical synchronization signal or the generated second vertical synchronization signal, thereby preventing both backlight flicker and wavy noise that have a trade-off relationship.

In addition, in the backlight driver and the method of driving the same according to the present invention, when the period difference between adjacent first vertical synchronization signals is within a threshold range, a duty ratio difference due to the period difference can be regarded as unrecognized, and thus, the first vertical synchronization signal may be directly output as the third vertical synchronization signal.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A backlight driver, comprising:

a vertical synchronization signal filter configured to:

generate a second vertical synchronization signal based on an input first vertical synchronization signal; and select one of the first vertical synchronization signal and the second vertical synchronization signal as a third vertical synchronization signal according to whether a period difference between adjacent first vertical synchronization signals satisfies a preset threshold range;

a duty ratio detector for detecting a duty ratio of an input pulse width modulation (PWM) signal;

a PWM generator configured to:

generate an output PWM signal using the third vertical synchronization signal output from the vertical synchronization signal filter and having the duty ratio; and output the output PWM signal to a backlight unit; and a frequency analyzer disposed at an input terminal of the vertical synchronization signal filter and configured to detect and output a first period of the first vertical synchronization signal, wherein the vertical synchronization signal filter is further configured to:

generate a second period of the second vertical synchronization signal based on the first period of the first vertical synchronization signal and a time difference between the start timings of the first vertical synchronization signal and the second vertical synchronization signal, select one of the first vertical synchronization signal and the second vertical synchronization signal as the third vertical synchronization signal according to whether a difference between first periods of adjacent first vertical synchronization signals satisfies the threshold range, and select one of the first period of the first vertical synchronization signal and the second period of the second vertical synchronization signal as a third period of the third vertical synchronization signal, wherein the vertical synchronization signal filter comprises:

a second vertical synchronization signal generator configured to generate and output the second vertical synchronization signal with the second period, a time difference detector configured to detect a time difference between the start timings of the first vertical synchronization signal and the second vertical synchronization signal from the second vertical synchronization signal generator, a first difference calculator configured to calculate a first difference between the first period of the first vertical synchronization signal and the time difference from the time difference detector to output the second period of the second vertical synchronization signal, a second difference calculator configured to calculate and output a second difference between the first periods of the adjacent first vertical synchronization signals, a determining unit configured to determine whether the second difference from the second difference calculator satisfies a preset threshold range to generate a flag signal, a first multiplexer configured to select one of the first vertical synchronization signal and the second vertical synchronization signal as the third vertical synchronization signal in response to the flag signal from the determining unit, and a second multiplexer configured to select one of the first period of the first vertical synchronization signal and the second period of the second vertical synchronization signal as the third period of the third vertical synchronization signal, in response to the flag signal from the determining unit.

2. The backlight driver of claim 1, wherein:

the first multiplexer selects the first vertical synchronization signal and the second multiplexer selects the first period of the first vertical synchronization signal when the second difference satisfies the preset threshold range; and the first multiplexer selects the second vertical synchronization signal and the second multiplexer selects the second period of the second vertical synchronization signal when the second difference does not satisfies the preset threshold range.

3. The backlight driver of claim 1, wherein the determining unit is further configured to determine whether the second difference is within the preset threshold range set by a preset minimum threshold value and a preset maximum threshold value.

4. A method of driving a backlight driver, the method comprising:

generating a second vertical synchronization signal based on an input first vertical synchronization signal;

selecting one of the first vertical synchronization signal and the second vertical synchronization signal to output as a third vertical synchronization signal according to whether a period difference between adjacent first vertical synchronization signals satisfies a preset threshold range;

detecting a duty ratio of an input pulse width modulation (PWM) signal;

generating an output PWM signal synchronized with the third vertical synchronization signal and having the duty ratio;

outputting the output PWM signal to a backlight unit, and detecting and outputting a first period of the first vertical synchronization signal, wherein the outputting of the third vertical synchronization signal comprises:

generating a second period of the second vertical synchronization signal based on the first period of the first vertical synchronization signal and a time difference between the start timings of the first vertical synchronization signal and the second vertical synchronization signal, selecting one of the first vertical synchronization signal and the second vertical synchronization signal as the third vertical synchronization signal according to whether a difference between first periods of adjacent first vertical synchronization signals satisfies the preset threshold range, and selecting one of the first period of the first vertical synchronization signal and the second period of the second vertical synchronization signal as a third period of the third vertical synchronization signal, and wherein the outputting of the third vertical synchronization signal further comprises:

generating and outputting the second vertical synchronization signal with the second period, detecting a time difference between the start timings of the first vertical synchronization signal and the second vertical synchronization signal, calculating a first difference between the first period of the first vertical synchronization signal and the detected time difference to output the second period of the second vertical synchronization signal, calculating and outputting a second difference between the first periods of the adjacent first vertical synchronization signals, determining whether the second difference satisfies a preset threshold range to generate a flag signal, selecting one of the first vertical synchronization signal and the second vertical synchronization signal as the third vertical synchronization signal in response to the flag signal, and selecting one of the first period of the first vertical synchronization signal and the second period of the second vertical synchronization signal as the third period of the third vertical synchronization signal, in response to the flag signal.

5. The method of claim 4, wherein:

the first vertical synchronization signal and the first period of the first vertical synchronization signal are selected when the second difference satisfies the preset threshold range; and the second vertical synchronization signal and the second period of the second vertical synchronization signal are selected when the second difference does not satisfies the preset threshold range.

6. The method of claim 4, wherein the determining comprises determining whether the second difference is within the preset threshold range set by a preset minimum threshold value and a preset maximum threshold value.

7. A liquid crystal display device, comprising:

a display panel;

a backlight unit configured to provide light to the display panel; and a backlight driver configured to drive the backlight unit, the backlight driver comprising:

a vertical synchronization signal filter configured to:

generate a second vertical synchronization signal based on an input first vertical synchronization signal; and select one of the first vertical synchronization signal and the second vertical synchronization signal as a third vertical synchronization signal according to whether a period difference between adjacent first vertical synchronization signals satisfies a preset threshold range;

a duty ratio detector configured to detect a duty ratio of an input pulse width modulation PWM signal;

a PWM generator configured to:

generate an output PWM signal using the third vertical synchronization signal output from the vertical synchronization signal filter and having the duty ratio; and output the output PWM signal to a backlight unit; and a frequency analyzer disposed at an input terminal of the vertical synchronization signal filter and configured to detect and output a first period of the first vertical synchronization signal, wherein the vertical synchronization signal filter is further configured to:

generate a second period of the second vertical synchronization signal based on the first period of the first vertical synchronization signal and a time difference between the start timings of the first vertical synchronization signal and the second vertical synchronization signal, select one of the first vertical synchronization signal and the second vertical synchronization signal as the third vertical synchronization signal according to whether a difference between first periods of adjacent first vertical synchronization signals satisfies the threshold range, and select one of the first period of the first vertical synchronization signal and the second period of the second vertical synchronization signal as a third period of the third vertical synchronization signal, and wherein the vertical synchronization signal filter comprises:

a second vertical synchronization signal generator configured to generate and output the second vertical synchronization signal with the second period, a time difference detector configured to detect a time difference between the start timings of the first vertical synchronization signal and the second vertical synchronization signal from the second vertical synchronization signal generator, a first difference calculator configured to calculate a first difference between the first period of the first vertical synchronization signal and the time difference from the time difference detector to output the second period of the second vertical synchronization signal, a second difference calculator configured to calculate and outputg a second difference between the first periods of the adjacent first vertical synchronization signals, a determining unit configured to determine whether the second difference from the second difference calculator satisfies a preset threshold range to generate a flag signal, a first multiplexer configured to select one of the first vertical synchronization signal and the second vertical synchronization signal as the third vertical synchronization signal in response to the flag signal from the determining unit, and a second multiplexer configured to select one of the first period of the first vertical synchronization signal and the second period of the second vertical synchronization signal as the third period of the third vertical synchronization signal, in response to the flag signal from the determining unit.

8. The liquid crystal display device of claim 7, wherein:

when the second difference satisfies the preset threshold range:

the first multiplexer is further configured to select the first vertical synchronization signal; and the second multiplexer is further configured to select the first period of the first vertical synchronization signal; and when the second difference does not satisfies the preset threshold range:

the first multiplexer is further configured to select the second vertical synchronization signal; and the second multiplexer is further configured to select the second period of the second vertical synchronization signal.

9. The liquid crystal display device of claim 7, wherein the determining unit is further configured to determine whether the second difference is within the preset threshold range set by a preset minimum threshold value and a preset maximum threshold value.

* * * * *